United States Patent [19]

Walter

[11] Patent Number: 4,936,471

[45] Date of Patent: Jun. 26, 1990

[54] CARRYING APPARTUS FOR MERCHANDISE DISPLAY ELEMENTS

[75] Inventor: Herbert Walter, Müllheim, Fed. Rep. of Germany

[73] Assignee: Protoned B.V., Amsterdam

[21] Appl. No.: 227,815

[22] Filed: Aug. 3, 1988

[30] Foreign Application Priority Data

May 24, 1988 [CH] Switzerland ..... 1958/88

[51] Int. Cl.[5] ..... A47F 5/00

[52] U.S. Cl. ..... 211/189; 211/182; 211/192; 211/206

[58] Field of Search ..... 211/189, 186, 182, 192, 211/206, 205

[56] References Cited

U.S. PATENT DOCUMENTS

| | | | |
|---|---|---|---|
| 3,936,111 | 2/1976 | Mazzucconi | 211/189 X |
| 3,968,882 | 7/1976 | Mello | 211/189 |
| 3,986,316 | 10/1976 | Blodee | 211/189 X |
| 4,439,052 | 3/1984 | Wallther | 211/192 X |
| 4,494,896 | 1/1985 | Difranco | 211/192 X |
| 4,730,739 | 3/1988 | Semerau | 211/189 |

*Primary Examiner*—Robert W. Gibson, Jr.
*Attorney, Agent, or Firm*—Brumbaugh, Graves, Donohue & Raymond

[57] ABSTRACT

The carrying apparatus for merchandise display elements is made up of substantially free-standing columns (2) with supporting bars (4) detachably fixed between neighboring columns. The said supporting bars are suspended by means of coupling devices at both their ends in coupling rings (3) of the columns (2) and contain along their surface openings (5) for receiving carrying members (6), in the form of coat hanger carriers (7, 7,') or shelf carriers (8, 8') etc., supporting the merchandise display elements.

The columns (2) and the supporting bars (4) can be used to set up on the modular principle carrying apparatuses made in linear form, interrupted in any way, or with supporting bars extending in stellar form from a central columns (sic) (2).

6 Claims, 4 Drawing Sheets

CARRYING APPARTUS FOR MERCHANDISE DISPLAY ELEMENTS

Figure 1A:
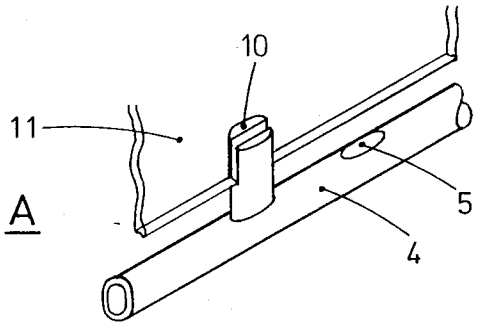
Figure 1B:
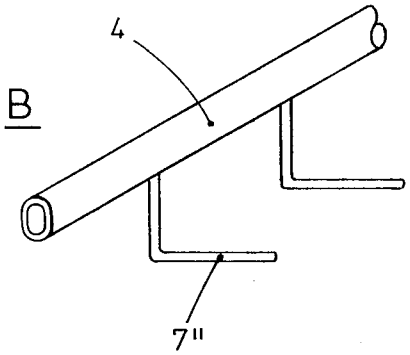

The present invention relates to a carrying apparatus for merchandise display elements, and specifically for set up in sales and demonstration areas.

It is customary to combine merchandise display elements, in the form of arms or shelves for receiving coat hangers in ready-made clothes sales areas or for the display of piece goods, together with stands or wall mounts. When these display devices are designed on the basis of a modular system, they are mainly very adaptable both to spatial conditions and to the articles to be displayed. Combinations of arms can be utilized. These arms can be suspended on carrying walls or carrying columns on which items of clothing can be displayed visibly. Free-standing display rack arrangements are used in clothing sales areas in many forms, and are even provided with vertically adjustable arms and carriers which can swivel and rotate all around.

However, arm arrangements which can be suspended on columns and carrying walls are confined to their fixed position. They are usually only adaptable in the display height. Stand apparatuses are easily relocatable but can only be incorporated in a limited extent in decoration projects when planning the display of different articles.

The object of the invention is to create a carrying apparatus for merchandise display elements which can be easily adapted to both spatial and aesthetic requirements of the merchandise display concerned.

This object is achieved according to the invention by the defining features of patent claim 1. Embodiments are defined by the dependent claims.

The main advantage of the carrying apparatus according to the invention is that linear arrangements, interrupted in any way, and stellar arrangements of the carrying apparatus can be set up in a way which is adapted precisely to the spatial conditions existing in the particular location. A further advantage is the floor clearance between neighboring column members due to the vertical position of the supporting bar extending between the column members.

Figure 1:
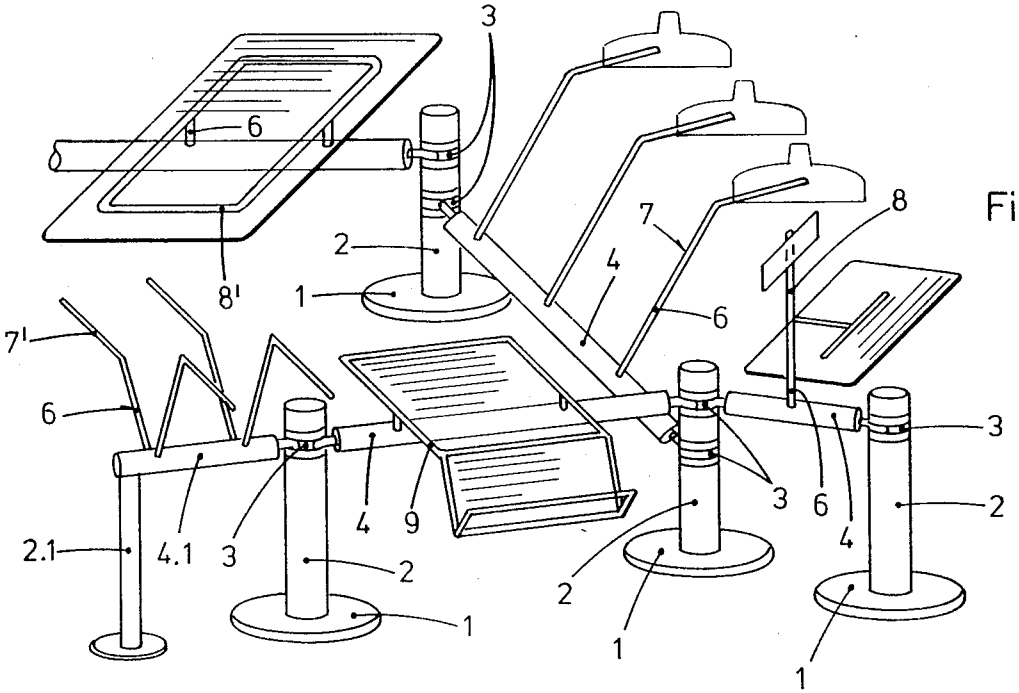

Exemplary embodiments of the carrying apparatus according to the invention and details thereof are described below with reference to the drawing, in which:

FIG. 1 shows, in a perspective form of representation, a carrying apparatus according to the invention, provided with a plurality of side pieces and with a plurality of merchandise display elements designed for various purposes, together with two sectional details A and B.

Figure 3:
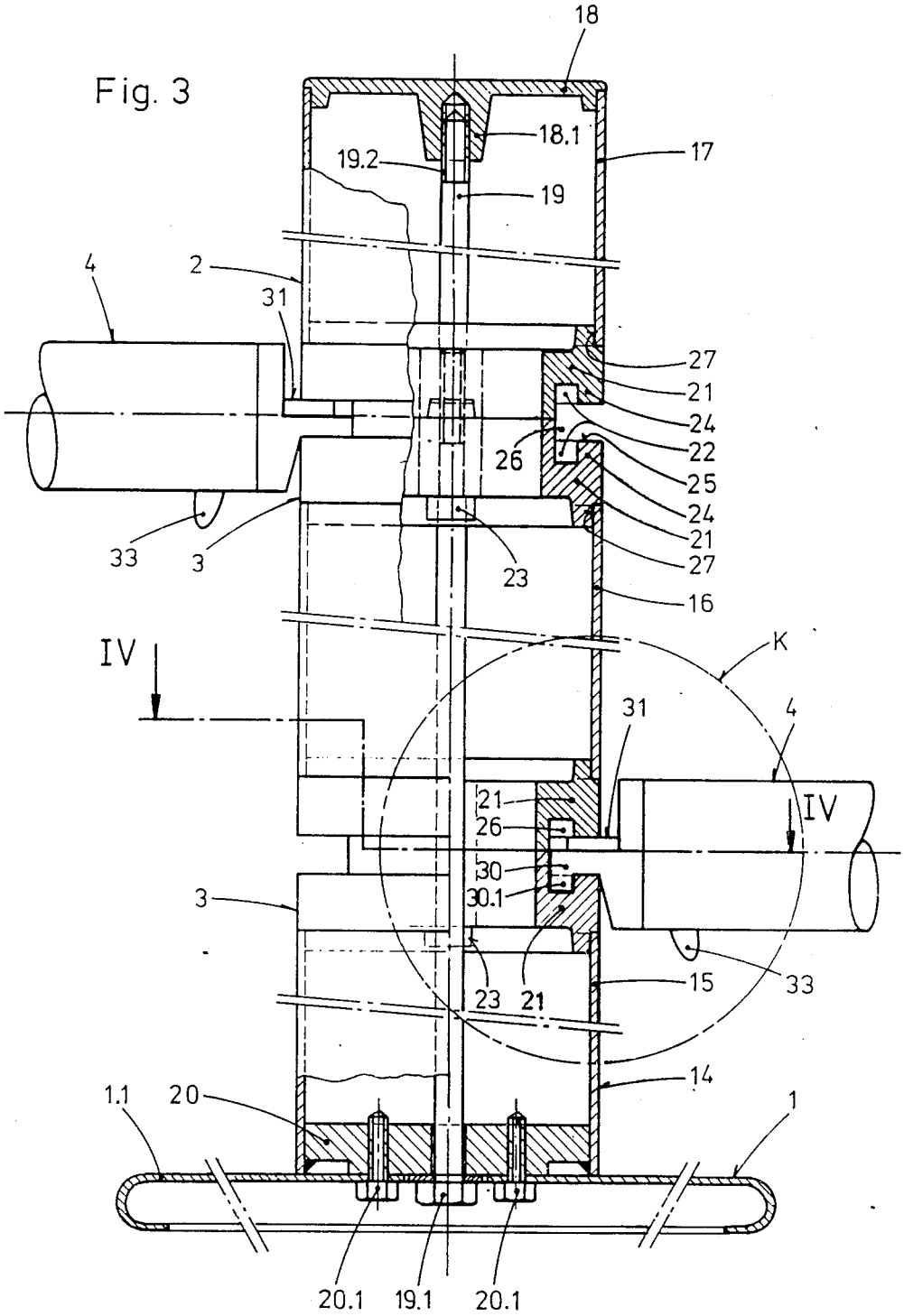
Figure 4:
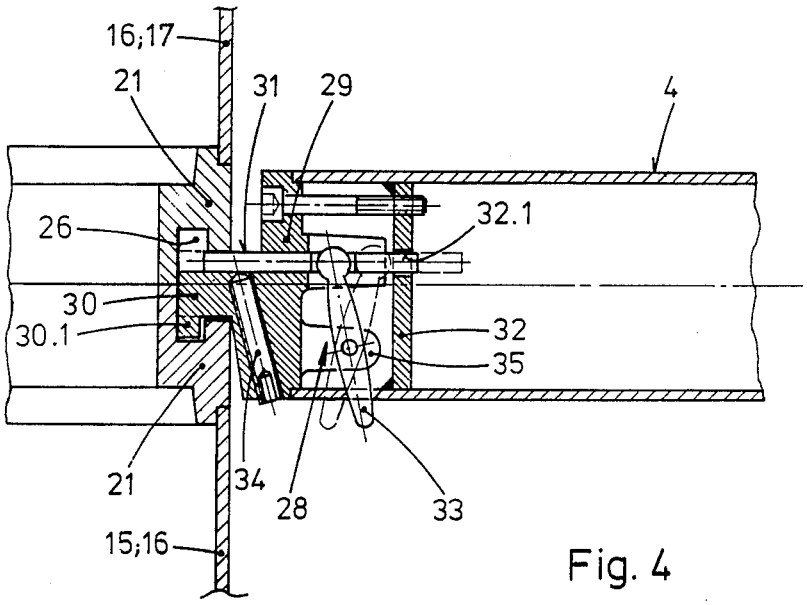
Figure 5:
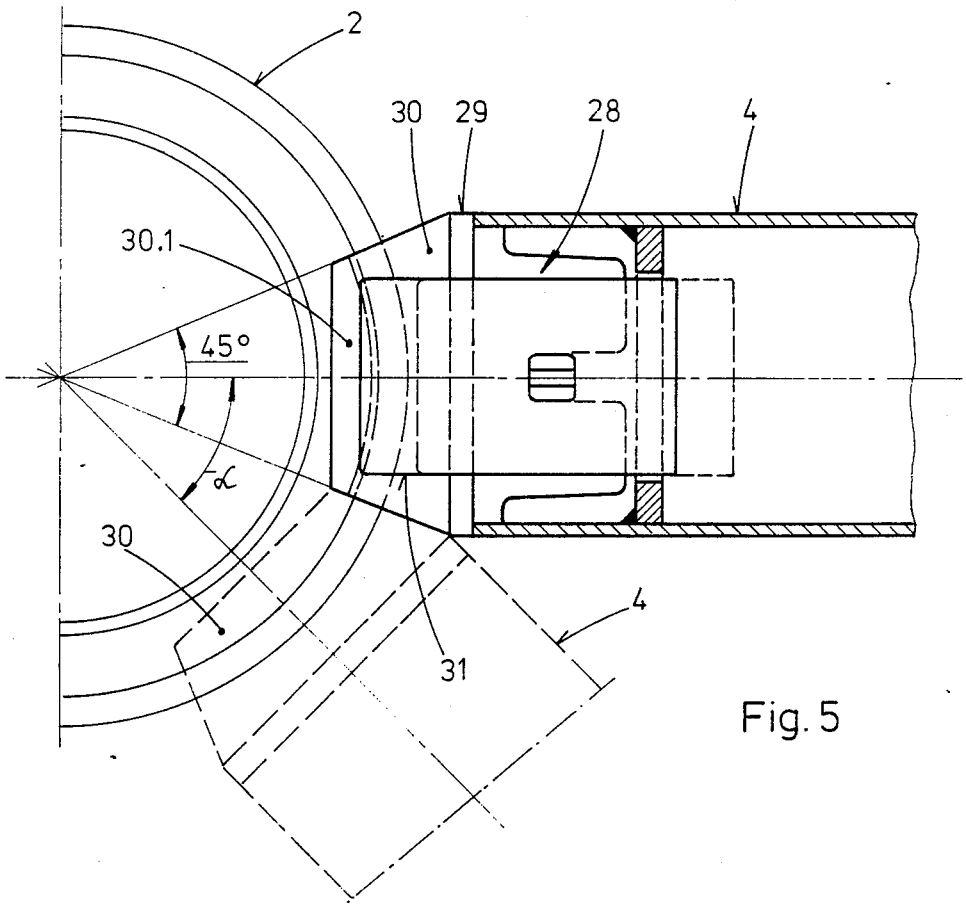

FIGS. *2a–d* show a number of outline representations for design variants of the carrying apparatus according to the invention and possible ways of developing it, FIG. 3 shows a column element, partially in section, with two supporting bars connected to it, FIG. 4 shows details of the supporting bar connection to a coupling ring in the region bounded by a circle K in FIG. 3, and FIG. 5 shows a section along the line IV—IV in FIG. 3 for representation of the supporting bar connection.

On free-standing columns 2, provided with a broadly based floor rest 1, for example in the form of a dish-shaped foot 1.1 (FIG. 3), supporting bars 4 are connected in the region of coupling rings 3. These supporting bars 4, which extend in each case between two colums 2, have at both their ends a coupling device in the form of a slide or hook mechanism, the details of which are described together with the details of an embodiment of the coupling rings 3 with reference to FIGS. 3 and 4. The coupling rings 3 may also have attached to them so-called cantilever supporting bars 4.1 of smaller length than the supporting bars 4, which are provided at their outer end with a firmly connected auxiliary column 2.1 as supporting member. These supporting bars are preferably tubular pieces from round or polygonal tube sections. Bore holes 5 are made in their surface for directly or indirectly receiving supporting members 6 of merchandise display elements in the form of coat hanger carriers 7, 7', 7'', shelf carriers 8, 8', presentation tables 9 etc. or guiding mounts 10 for glass or billboard walls 11, which bore holes combine with guide or clamping means (not shown) to allow a convenient interchanging of the said carrier elements.

FIGS. *2a–d* show exemplary embodiments of the carrying apparatus according to the invention in outline. In FIG. *2a*, a linear arrangement of column members 2 and supporting beams 4 disposed along a curved line approximately parallel to a building wall 12 and capable of being provided with any merchandise display elements, for example according to FIG. 1, are shown. For example, for one supporting bar 4.2 of these, a viewing or packing table 13 may be mounted. Configurations b–d show I, V and Y arrangements of column members 2 and 2.1 with supporting bars 4 and 4.1, which can be provided with carrier elements in the way shown in FIG. 1. The respective angles between the neighboring supporting bars 4 in the V and Y arrangements are variable within the scope of the possibilities for connecting the supporting bars 4 on a coupling ring 3. This emerges from the explanation of FIG. 5.

The column member 2, shown in partial section in FIG. 3 and having two supporting bars 4 connected to it, is made up of a base element 14, bolted to the floor rest 1, and a first tubular casing piece 15, on which a first coupling ring 3 is centered and fitted. On this first coupling ring 3 there follows a second tubular casing piece 16 in the manner of a spacer element with respect to a second coupling ring 3, which is followed by a third tubular casing piece 17. The total length of the casing pieces 15, 16 and 17 may be variable and thus determines the overall height of the column member. The top casing piece 17 is finished off by an end cap 18, which is centered in the casing piece 17. The components of the column member 2 are held together by a screw bolt 19, the head end 19.1 of which bears at the bottom against the base element 14 and the threaded end 19.2 of which engages in a screw hub 18.1 on the end cap 18.

The base element 14 contains an anchor plate 20, which is welded into the first casing piece 15 and rests flush with the latter at the top on the floor rest 1, designed as a dish-shaped foot 1. The latter is detachably bolted to the anchor plate 20 by means of screws 21.

The design of the coupling rings 3 is best illustrated by the section in FIG. 3, while an embodiment of the supporting bar connection is explained with reference to FIGS. 4 and 5. In FIG. 3, flange rings 21 are shown, which are expediently identically shaped and arranged mirror-symmetrically and which establish an inner annular clearance 22. The two flange rings 21 are connected solidly to each other and form a cage-like formation, on which an entry slot 25, bonded axially by marginal webs 24, leads radially inward to an annular clamping space 26, bounded by the clearances 22. The flange rings 21 are also each provided with a peripheral recess 27, by which they are centered in the neighboring casing pieces 15, 16 and 17, respectively.

At both ends of the supporting bars 4 there are provided, according to FIGS. 4 and 5, coupling devices 28, which are centered on the ends of the bars and the main components of which are a clamping block 29 with a bolt 30 and a catch lug 30.1, as well as an axially movable catch slide 31. The bolt 30, together with the catch lug 30.1, are parts of the clamping block 29 and its overall height is slightly less than that of the entry slot 25 to the clamping space 26 at the coupling ring 3, to make the coupling operation possible. The axially movable catch slide 31 is mounted in a guide slot in the clamping block 29. For fixing of the clamping block 29 on the end of the supporting bar, the latter is provided on the inside of the tube with a welded-in fitting plate 32 which, as well as threaded fixing holes, also contains a through-opening 32.1 for the catch slide 31, as its second bearing point in the coupling device 28. The catch slide 31 is displaceable between a release position and a blocking position, being pivotally mounted in a supporting fork 35 on the clamping block 29.

During assembly of the supporting bars 4 and of the column members 2, it must be ensured that the catch slide 31 is in its retracted position. The bolt 30, together with catch lug 30.1, can then be introduced through the entry slot 25 of the clamping space 26 into the latter and lowered therein in such a way that the catch lug 30.1 engages in the lower clearance 22. There is then sufficient space between the upper side of the bolt 30 and the underside of the marginal web 24 at the upper flange ring 21 to displace the catch slide 31 into the clamping space 26. The bolt 30 is then captured in the clamping space 26. The catch slide 31 can be arrested in this position by tightening a set screw 34. At the same time, the catch slide 31 and the bolt 30 are pressed apart in such a way that they come into firm contact with the marginal webs 24 on the flange rings 21. The coupling operation is completed.

To release the coupling connection, the reverse procedure is adopted; after loosening the said set screw 34, the catch slide 31 is brought into its return position by the lever 33. The bolt 30, together with the catch lug 30.1, can then be removed from the clamping space through the entry slot 25 and the column member 2 and/or the supporting bar 4 are freely movable.

Figure 2A:
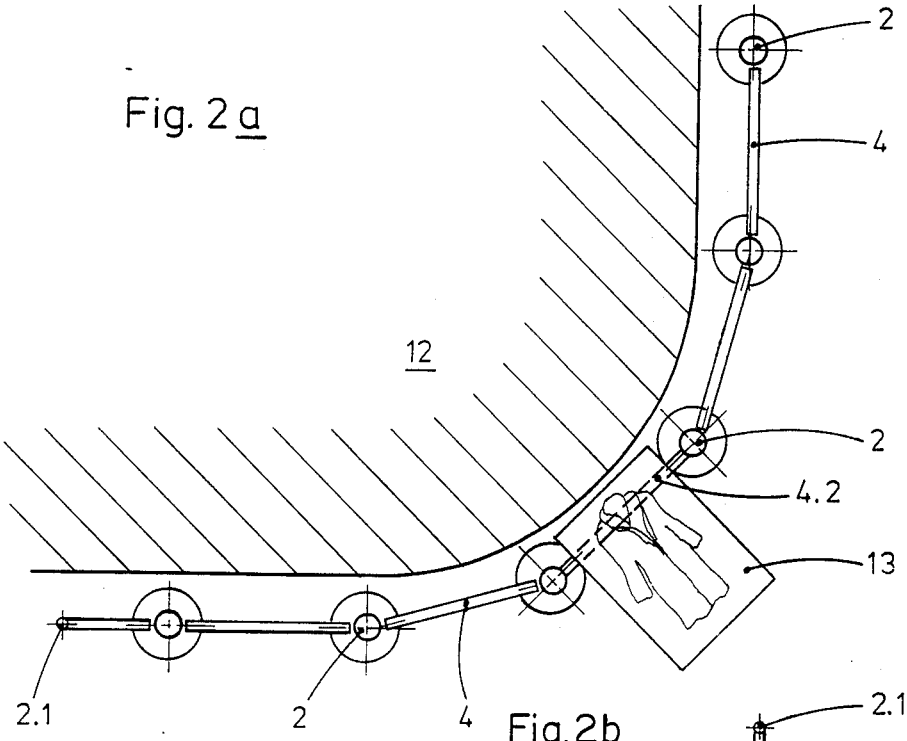
Figure 2B:
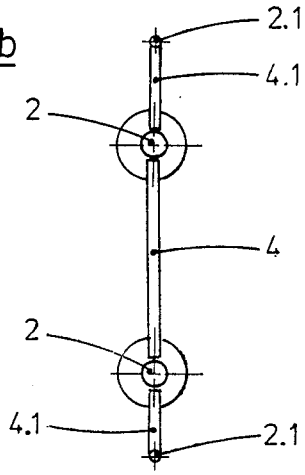
Figure 2D:
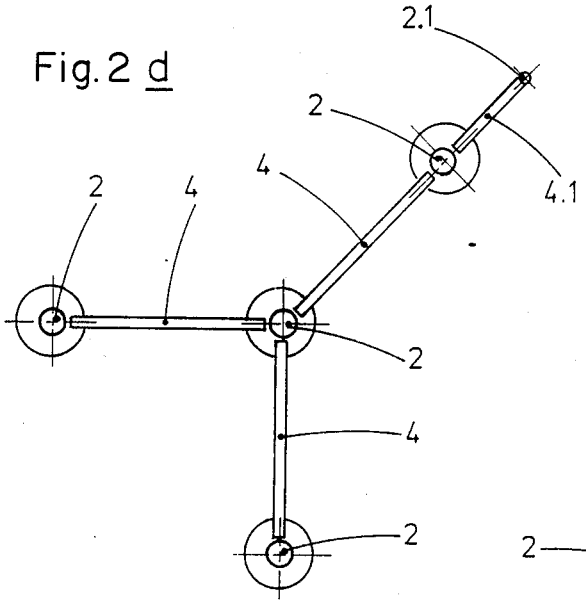
Figure 2C:
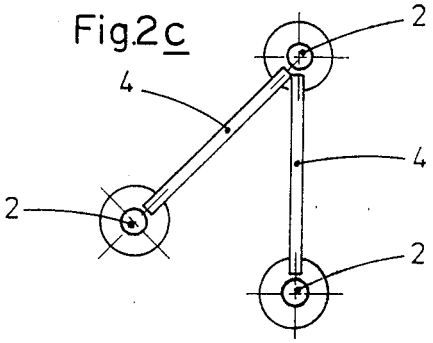

In order that a plurality of supporting bars 4 can be arranged on the same coupling ring 3 with closest possible angles between them (see in particular FIG. 2*c*), the bolt 30 on the clamping block 29 and the catch lug 30.1, formed on the bolt, are shaped to taper conically toward the center of the column member 2, the bolt 30 being offset in such a way that its radially inner end just touches against the bottom of the clamping space 26. FIG. 5 shows a correspondingly designed clamping block 29 with a bolt 30 tapering conically at 45°. The smallest closure angle $\alpha$ of the one neighboring supporting bar 4 (shown in broken lines) is then likewise 45°. Smaller or greater cone angles between 30° and 60° are possible.

I claim:

1. A merchandise display system comprising:

a plurality of at least two free-standing support columns each adapted to be supported on a supporting surface and to be readily moved with respect to each other, each column having at least one coupling ring thereon located at a predetermined height above the supporting surface, each coupling ring being formed to provide an inwardly directed annular circumferential clamping space open in a radial direction;

at least one elongate cylindrical support bar having a coupling device secured to each end thereof, each said coupling device being centered at an end of a respective support bar and comprising a releasable hook mechanism dimensioned to be received in the annular clamping space of a respective coupling ring for releasably securing the support bar, at its ends, to two columns spaced from each other by the length of the support bar, said support bar having a plurality of at least two spaced apart bore holes formed in its peripheral surface oriented upwardly when the bar is in the position of use; and at least one merchandise-carrying member for supporting and displaying merchandise, said merchandise-carrying member having at least one downwardly directed support member dimensioned to be inserted in a bore hole in said support bar for detachably securing said merchandise-carrying member on said support bar.

2. A merchandise display system according to claim 1, wherein said releasable hook mechanism comprises a clamping block anchored at an end of a supporting bar and including a bolt having a catch lug formed thereon for engaging the annular clamping space of a coupling ring, a catch slide mounted in said clamping block for axial movement relative thereto between a release position and a block position and means for releasably securing said catch slide in said block position for locking said catch lug in the annular clamping space.

3. A merchandise display system according to claim 2, wherein the bolt on said clamping block and said catch lug are both conically tapered toward the center of a support column on which it is supported for maximizing the number of support bars that can be coupled to the coupling ring of a given support column.

4. A merchandise display system according to claim 1, wherein each coupling ring comprises two substantially identically shaped flange rings arranged mirror-symmetrically with respect to each other and solidly connected to each other.

5. A merchandise display system according to claim 1, wherein said system comprises a multiplicity of three or more of said support columns each readily movable with respect to the others for accommodating the system to the spatial characteristics of a display area;

a multiplicity of elongate cylindrical support bars each coupled between two of said support columns, some of which may have two or more support bars coupled thereto; and a plurality of differently configured merchandise-carrying members each detachably secured to a support bar for supporting a kind of merchandise adapted to its configuration.

6. A merchandise display system according to claim 5, wherein at least two of said support columns have two or more coupling rings thereon located at first and second predetermined different heights, wherein a first support bar is coupled between the coupling rings of first and second support columns located at said first predetermined height and a second support bar is coupled between the coupling rings of said first and a third support column located at said second predetermined height.

* * * * *